US006374211B2

(12) United States Patent
Stegmann et al.

(10) Patent No.: US 6,374,211 B2
(45) **Date of Patent: *Apr. 16, 2002**

(54) VOICE ACTIVITY DETECTION METHOD AND DEVICE

(75) Inventors: Joachim Stegmann, Darmstadt; Gerhard Schroeder, Dieburg, both of (DE)

(73) Assignee: Deutsche Telekom AG, Bonn (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/064,248

(22) Filed: Apr. 22, 1998

(30) Foreign Application Priority Data

Apr. 22, 1997 (DE) ..... 197 16 862

(51) Int. Cl.[7] ..... G10L 19/14
(52) U.S. Cl. ..... 704/211; 704/201
(58) Field of Search ..... 704/211, 212, 704/246, 248, 249, 233

(56) References Cited

U.S. PATENT DOCUMENTS

| | | | | |
|---|---|---|---|---|
| 5,152,007 A | * | 9/1992 | Uribe | 455/116 |
| 5,388,182 A | | 2/1995 | Bennedetto et al. | 395/2.14 |
| 5,528,725 A | * | 6/1996 | Hui | 704/236 |
| 5,822,726 A | * | 10/1998 | Taylor | 704/233 |
| 5,781,881 A | * | 7/1999 | Stegmann | 704/211 |

FOREIGN PATENT DOCUMENTS

| | | |
|---|---|---|
| DE | 195 38 852 | 10/1995 |
| DE | 196 00 404 | 1/1996 |
| EP | 06 80 034 | 11/1995 |
| EP | 0 714 088 | 5/1996 |

* cited by examiner

*Primary Examiner*—Fan Tsang
*Assistant Examiner*—Michael N. Opsasnick
(74) *Attorney, Agent, or Firm*—Kenyon & Kenyon

(57) ABSTRACT

A method and a circuit arrangement for automatic voice activity detection on the basis of the wavelet transformation. A voice activity detection circuit or module (5) is used to control a speech encoder (9) and a speech decoder (22), as well as a background noise encoder (10) and a background noise decoder (23) in order to perform source-controlled reduction of the mean transmission rate. After segmenting a speech signal, a wavelet transformation is computed for each frame, from which a set of parameters is determined, from which in turn a set of binary decision variables is calculated with the help of fixed thresholds in an arithmetic circuit (32). The decision variables control a decision logic circuit (42), whose result, after time smoothing in a time smoothing circuit (44), provides the statement "speech present/no speech" for each frame. The circuit itself includes segmenting circuit (28), a wavelet transformation circuit (30), an arithmetic circuit for the energy values (32), a pause detection circuit (34), a circuit for detecting stationary states (35), a first and a second background detector (36, 37), a downstream decision logic (42), and the circuit (44) for time smoothing, which provides the desired statement at its output (45).

8 Claims, 2 Drawing Sheets

VOICE ACTIVITY DETECTION METHOD AND DEVICE

FIELD OF THE INVENTION

The present invention relates to a method and circuit arrangement for automatically recognizing speech activity in transmitted signals.

RELATED TECHNOLOGY

For digital mobile telephone or speech memory systems, and in many other applications, it is advantageous to transmit speech encoding parameters discontinuously. In this was the bit rate can be reduced considerably during pauses in speech or time periods dominated by background noise. Advantages of discontinuous transmission in mobile terminals include lower energy consumption. Such lower energy consumption may be due to a higher mean bit rate for simultaneous services such as data transmission or to a higher memory chip capacity.

The extent of the benefit afforded by discontinuous transmission depends on the proportion of pauses in the speech signal and the quality of the automatic voice activity detection device needed to detect such periods. While a low speech activity rate is advantageous, active speech should not be cut off so as to adversely affect speech quality. This tradeoff is a basic challenge in devising automatic voice activity detection systems, especially in the presence of high background noise levels.

Known methods of automatic voice activity detection typically employ decision parameters based on average time values over constant-length windows. Examples include autocorrelation coefficients, zero crossing rates or basic speech periods. These parameters afford only limited flexibility for selecting time/frequency range resolution. Such resolution is normally predefined by the frame length of the respective speech encoder/decoder.

In contrast, the known wavelet transformation technique computes an expansion in the time/frequency range. The calculation results in low frequency range resolution but high time range resolution at high frequencies and low time range resolution but high frequency range resolution at low frequencies. These properties well-suited for the analysis of speech signals, have been used for the classification of active speech into the categories voiced, voiceless and transitional. See German Offenlegungsschrift 195 38 852 A1 "Verfahren und Anordnung zur Klassifizierung von Sprachsignalen" (Method of and Arrangement for Classifying Speech Signals), 1997, related to U.S. patent application Ser. No. 08/734,657 filed Oct. 21, 1996, which U.S. application is hereby incorporated by reference herein.

The known methods and devices discussed are not necessarily prior art to the present invention.

SUMMARY OF THE INVENTION

An object of the present invention is therefore to provide a method and a circuit arrangement, based on wavelet transformation, for voice activity detection to determine whether speech or speech sounds are present in a given time segment.

The present invention therefore provides a method of automatic voice activity detection, based on the wavelet transformation, characterized in that a voice activity detection circuit or module (5), controlling a speech encoder (7) and a speech decoder (22), as well as a background noise encoder (10) and a background noise decoder (23), is used to achieve source-controlled reduction of the mean transmission rate; a wavelet transformation is computed for each frame after segmentation of a speech signal, a set of parameters is determined from said wavelet transformations, and a set of binary decision variables is determined from said parameters, using fixed thresholds, in an arithmetic circuit or a processor (32), said decision variables controlling a decision logic (42), whose result provides a "speech present/no speech" statement after time smoothing for each frame.

The present invention also provides a circuit arrangement for performing a method of automatic voice activity detection, based on wavelet transformation. The circuit arrangement is characterized in that the input speech signals go to the input (1) of a transfer switch (4). A voice activity detection circuit or module (5) is connected to the input (1), and the output of said voice activity detection circuit controls said transfer switch (4) and another transfer switch (13), and is connected to a transmission channel (16). The output of the transfer switch (4) is connected, via lines (7, 8), to a speech encoder (9) and a background noise encoder (10), whose outputs are connected, via lines (11, 12) to the inputs of the transfer switch (13), whose output is connected, via a line (15), to the input of the transmission channel (16). The transmission channel is connected to both another transfer switch (19) and, via a line (18), to the control of the transfer switch (19) and of a transfer switch (26) arranged at the output (27). A speech decoder (22) and a background noise decoder (23) are arranged between the two transfer switches (19 and 26).

The present method of automatic voice activity detection is applicable to speech encoders/decoders to achieve source-controlled reduction of the mean transmission rate. With the present invention, after segmentation of a speech signal, a wavelet transformation is computed for each frame to determine a set of parameters. From these parameters a set of binary decision variables is computed using fixed thresholds. The binary decision variables control a decision logic whose result delivers, after time smoothing, a "speech present/no speech present" statement for each frame. The present invention achieves a source-controlled reduction of the mean transmission rate by determining whether any speech is present in the time segment under consideration. This result can then be used for function control or as a pre-stage for a variable bit rate speech encoder/decoder.

Other advantageous embodiments of the present invention include:

(a) that after the wavelet transformation, a set of energy parameters is determined for each segment from the transformation coefficients and compared with fixed threshold values, whereby binary decision variables are obtained for controlling the decision logic (42), which provides an interim result for each frame at the output;

(b) that the interim result for each frame, determined by the decision logic, is post-processed by means of time smoothing, whereby the final "speech present or no speech" result is formed for the current frame;

(c) that background detectors (36, 37) are controlled using signals for detecting background noise, and the detail coefficients (D) are analyzed in the rough time interval (N) and detail coefficients (D2) are analyzed in the finer time interval (N/P); P represents the number of subframes and the relationships $Q1,Q2\epsilon(1.L)$ and $Q1>Q2$ apply: and (d) that the input (1) is connected to a segmenting circuit (28), whose output is connected, via a line (29), to a wavelet transformation circuit (30), which is connected to the input of an arithmetic circuit or a processor (32) for calculating the energy values: the output of the processor (32) is connected, via a line (33) and parallel to a pause detector (34), to a circuit for computing the measure of stationarity (35), a first background detector (36), and a second background detector (37); the outputs of said circuits (34 through 37) are connected to a decision logic (42), whose output is connected to a smoothing circuit (44) for time smoothing, and the output of the smoothing circuit (44) is also the output (45) of the voice activity detection device.

Further advantages of the voice activity detection method and the respective circuit arrangement are explained in detail below with reference to the embodiments.

BRIEF DESCRIPTION OF THE DRAWINGS

The present invention is now explained with reference to the drawings in which.

DETAILED DESCRIPTION

Figure 1:
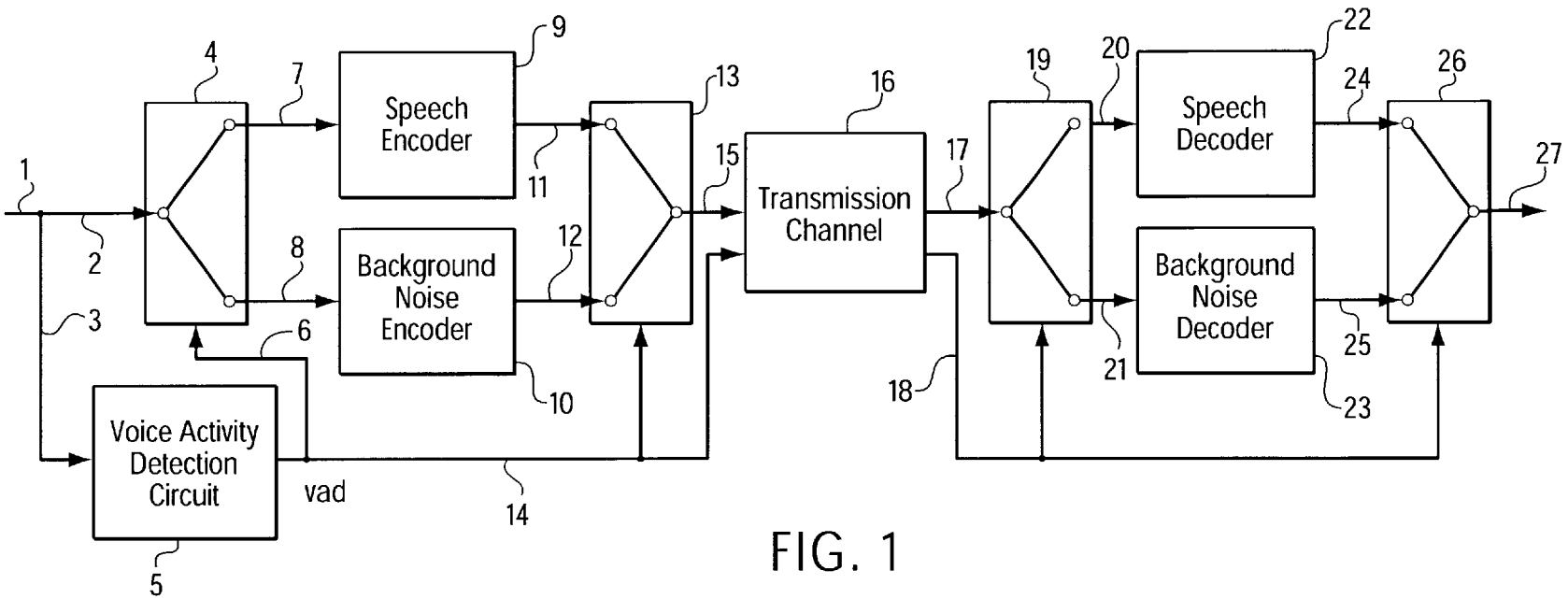
FIG. 1 shows a diagram for voice activity detection as the pre-stage of a variable-rate speech encoder/decoder.

FIG. 1 shows a diagram of the voice activity detection process of an embodiment of the present invention. As embodied herein, the process, which is preferably a pre-stage for a variable-rate speech encoder/decoder, receives input speech at input 1. The input speech goes to transfer switch 4 and to the input of voice activity detection circuit 5 via lines 2 and 3, respectively. Voice activity detection circuit 5 controls transfer switch 4 via feedback line 6. Transfer switch 4 directs the input speech either to line 7 or to line 8 depending on the output signal of voice activity detection circuit 5. Line 7 leads to speech encoder 9 and line 8 leads to background noise encoder 10. The bit stream output of speech encoder 9 provides an input to transfer switch 13 via line 11, while the bit stream of background noise encoder 10 provides another input to transfer switch 13 via line 12. Transfer switch 13 is controlled by the output signals of voice activity detection circuit 5, received via line 14.

The outputs of transfer switch 13 and of voice activity detection circuit 5 are connected, via lines 15 and 14, respectively, to a transmission channel 16. The output of transmission channel 16 provides an input to transfer switch 19 via line 17. The output of transmission channel 16 also provides control inputs to transfer switch 19 and transfer switch 26 via line 18. Transfer switch 19 is connected, via output lines 20 and 21, to a speech decoder 22 and a background noise decoder 23, respectively. The outputs of speech decoder 22 and background noise decoder 23 provide inputs, via lines 24 and 25, respectively, to transfer switch 26. Depending on the control signals on line 18, transfer switch 26 sends either decoded speech signals or decoded background noise signals to output 27.

Figure 2:
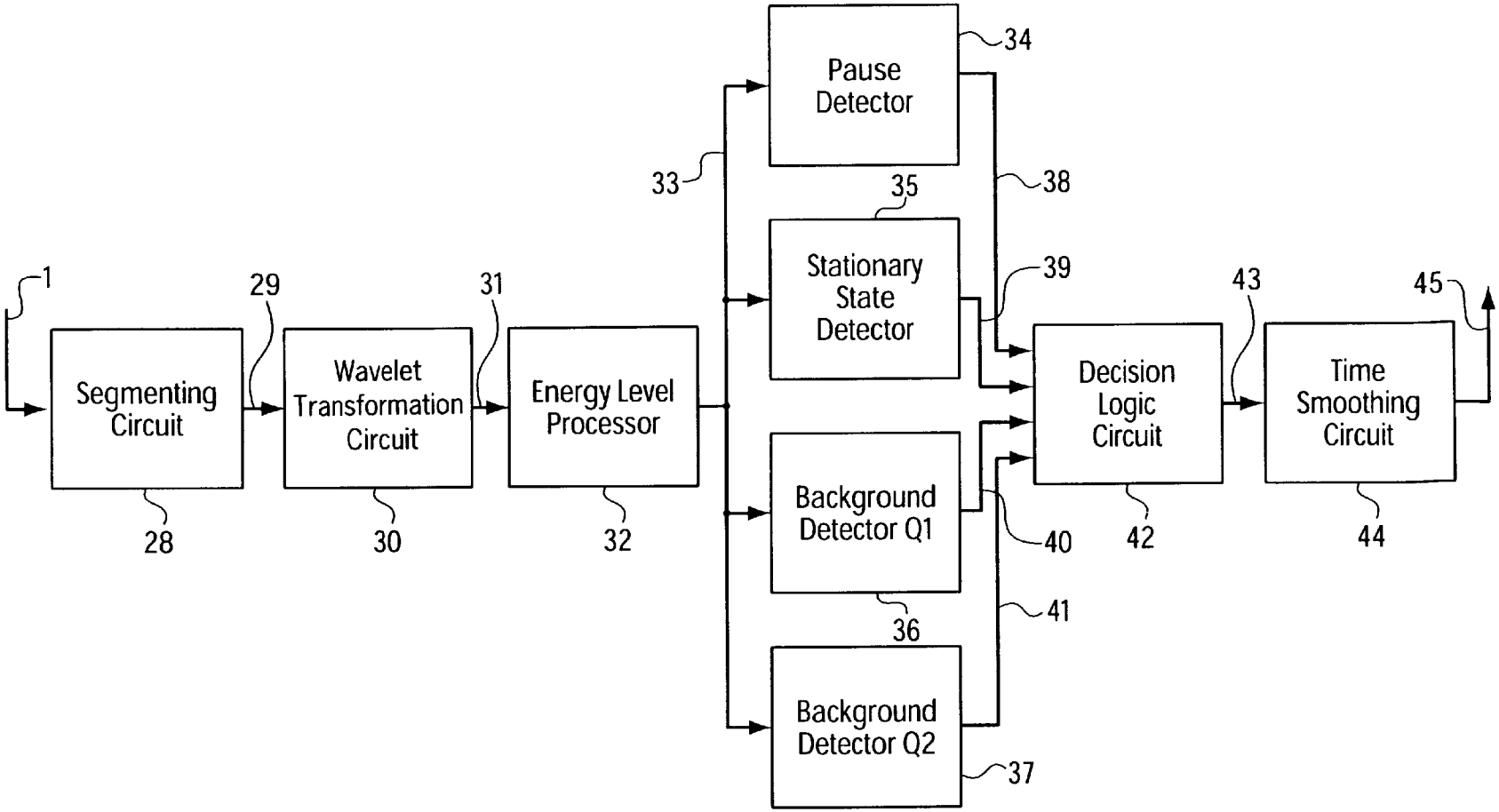
FIG. 2 shows a diagram of an automatic voice activity detection device.

FIG. 2 shows a diagram of an embodiment of an automatic voice activity detection device according to the present invention. As embodied herein, input speech is received at input 1 and relayed to segmenting circuit 28. The output of segmenting circuit 28 is transmitted via line 29 to a wavelet transformation circuit 30. Wavelet transformation circuit 30 is in turn connected via line 31 to the input of energy level processor 32. The output of energy level processor 32 is connected via line 33 to pause detector 34, stationary state detector 35, first background detector 36, and second background detector 37, all in parallel with each other. The outputs of pause detector 34, stationary state detector 35, first background detector 36, and second background detector 37 are connected, via lines 38 through 41, respectively, to decision logic circuit 42. The output of decision logic circuit 42 is connected to time smoothing circuit 44, which produces a time-smoothed output 45.

A method of automatic voice activity detection in accordance with an embodiment of the present invention may be described with further reference to FIG. 2. After segmentation of the input signal in segmenting circuit 28, the wavelet transformation for each segment is computed in wavelet transformation circuit 30. In processor 32, a set of energy parameters is determined from the transformation coefficients and compared to fixed threshold values, yielding binary decision parameters. These binary decision parameters control decision logic circuit 42, which provides an interim result for each frame. After smoothing in time smoothing circuit 44, a final "speech or no speech" result for the current frame is produced at output 45.

Further reference may now be had to the individual circuit blocks depicted in FIG. 2. In wavelet transformation circuit 30 input speech is divided into frames each with a length of N sampling values. N can be matched to a given speech encoding method. The discrete wavelet transformation is computed for each frame. Preferably, the transformation is performed recursively with a filter array having a high-pass filter or a low-pass filter. Such a filter array may be derived for many basic functions of the wavelet transformation. For example, as embodied herein. Daubechies wavelets and spline wavelets are used, as these result in a particularly effective implementation of the transformation using short-length filters.

In a first method, the filter array is applied directly to the input speech frame $s=(s(0), \ldots s(N-1))^T$ and both filter outputs are subsampled by a factor of two. A set of approximation coefficients $A_1=(A_1(\mathbf{0}), \ldots A_1(N/2-1))^T$ is obtained at the low-pass filter output, and a set of detail coefficients $D_1=(D_1(\mathbf{0}), \ldots D_1(N/2-1))^T$ is obtained at the high-pass filter output. This method is then applied recursively to the approximation coefficients of the previous step. This yields, as the result of the transformation in the last step 1 . . . a vector $DWT(s)=(D_1^T, D_2^T, \ldots D_L^T, D_L^T,)^T$, with a total of N coefficients.

An alternate method for computing the transformation is similarly based on a filter array expansion. In this alternate method, however, the filter outputs are not subsampled. This yields, after each step, vectors with length N and, after the last step, an output vector with a total of (L+1)N coefficients. To determine the resolution characteristics of the wavelet transformation, the filter pulse responses for each step is obtained from the previous step by oversampling by a factor of two. In the first step, the same filters are used as described in the preferred method described above. With greater redundancy in the visual display, the performance of the alternate method may be improved relative to the first method at a higher overall cost.

In order to eliminate boundary effects due to filter length M, the $M\ 2^{L-2}$ previous and the $M\ 2^{L-2}$ future sampling values of the speech frame are taken into account. To the extent possible, the filter pulse responses are centered around the time origin. This in effect extends the algorithm by $M\ 2^{L-2}$ sampling values. Such algorithm extension can be avoided by continuing the input frame periodically or symmetrically.

Initially, the frame energies $E_1, \ldots, E_L$ of detail coefficients $D_1, \ldots D_L$ and the frame energy $E_{tot}$ of the approximation coefficients $A_1$ are calculated by processor 32. The total energy of frame $E_{tot}$ can then be efficiently determined by totaling all the partial energies if the underlying wavelet base is orthogonal. All energy values are represented logarithmically.

Pause detector 34 compares the total frame energy $E_{tot}$ to a fixed threshold $T_1$ to detect frames with very low energy. A binary decision variable $f_{sil}$ is defined according to the following formula:

$$f_{sil} = \begin{cases} 1, & E_{tot} < T_1 \\ 0, & \text{otherwise} \end{cases}. \tag{1}$$

To obtain a measure of stationary or non-stationary frames when detecting stationary frames, the following difference measure is determined for each frame k:

$$\Delta^{(k)} = \sqrt{\frac{1}{L}\sum_{l=1}^{L}\left(E_i^{(k)} - E_i^{(k-1)}\right)^2} \tag{2}$$

The difference measure uses frame energies of the detail coefficients from all steps.

The binary decision variable $f_{stat}$ is now defined using threshold $T_2$ and taking into account the last K frames:

$$f_{stat} = \begin{cases} 1, & \Delta^{(k)} < T_2 \ \& \ \ldots \ \& (\Delta^{(k-K)} < T_2) \\ 0, & \text{otherwise} \end{cases} \tag{3}$$

The purpose of background noise detection circuits 36 and 37 is to produce a decision criterion that is insensitive to the instantaneous level of background noise. Wavelet transformation circuit 30 furthers this purpose. Detail coefficients $D_{01}$ are handled in rough time interval N, while detail coefficients $D_{02}$ are handled in finer time interval N/P, where P is the number of subframes. Background noise detection circuit 36 performs rough time resolution step Q, while background noise detection circuit 37 performs fine time resolution step Q2. The relationships Q1,Q2ϵ(1,L) and Q1>Q2 apply.

First, an estimated value $B_1$. Iϵ(Q1,Q2) is calculated for the instantaneous level of the background noise using the following equation:

$$B_i^{(k)} = \begin{cases} E_i^{(k)}, & B_i^{(k-1)} > E_i^{(k)} \\ \alpha B_i^{(k-1)} + (1-\alpha)E_i^{(k)}, & \text{otherwise} \end{cases} \tag{4}$$

where the time constant α is restrained by 0<α<1.

Then the following P subframe energies are determined from the detail coefficients $D_2$:

$$\epsilon^{(k,1)}{}_{Q2}, \ldots, \epsilon^{(k,P)}{}_{Q2}$$

A binary decision variable $f_{Q1}$ is determined for step Q1 and $f_{Q2}$ for step Q2 with the help of fixed thresholds $T_3$, $T_1$ according to the following two formulas:

$$f_{Q1} = \begin{cases} 1, & \left(E_{Q1}^{(k)} - B_{Q1}^{(k)}\right) < T_3 \\ 0, & \text{otherwise} \end{cases} \tag{5}$$

-continued $$f_{Q2} = \begin{cases} 1, & [(\epsilon_{Q2}^{(k,1)} - B_{Q2}^{(k)}) < T_4] \ \& \ldots \ \& \ [(\epsilon_{Q2}^{(k,2)} - B_{Q2}^{(k)} < T_4] \\ 0, & \text{otherwise} \end{cases}$$

The interim result $\text{vad}^{(pre)}$ of the automatic voice activity detection device is obtained in decision logic circuit 42 using equations (1), (3), (5), and (6) through the following logic relationship:

$$\text{vad}^{(pre)} = !(f_{sil} | (f_{Q1} \& f_{Q2} \& f_{stat})), \tag{7}$$

where "!," "|," and "&" denote the logic operators "not," "or," and "and."

Further steps Q3, Q4, etc., can also be defined, for which the background noise can be determined in the same fashion. Then further binary decision parameters $f_{Q3}$, $f_{Q4}$, etc., may be defined. These binary decision parameters may be taken into account in equation (7).

Time smoothing is performed in circuit 44. To take into account a long-term speech stationary state, the interim decision of VAD is time smoothed in a post-processing step. If the number of the last contiguous frames designated as active exceeds a value $C_B$, a maximum of a quantity $C_{11}$ more active frames are appended, as long as $\text{vad}^{(pre)}=0$. In this way, the voice activity detection device of the present invention produces a final decision vadϵ(0,1).

What is claimed is:

1. A method of automatic voice activity detection for achieving source-controlled reduction of a mean transmission rate, the method comprising the steps of:

segmenting a speech signal into frames;

computing a wavelet transformation for each frame;

determining a set of parameters from the wavelet transformation;

determining a set of binary decision variables as a function of the set of parameters using fixed thresholds in an arithmetic circuit or a processor;

controlling a decision logic circuit using the binary decision variables;

producing a "speech present" statement or a "no speech" statement;

after the wavelet transformation, determining a set of energy parameters for each segment from the transformation coefficients; and comparing the set of energy parameters with fixed threshold values to obtain binary decision variables for controlling the decision logic circuit; and post-processing an interim result for each frame through time smoothing to form the final "speech present" or "no speech" result for each frame;

wherein the decision logic circuit provides the interim result for each frame at an output.

2. The method as recited in claim 1 further comprising the steps of:

controlling background detectors using signals for detecting background noise;

analyzing first detail coefficients in a rough time interval and second detail coefficients in the finer time interval, the finer time interval being smaller than the rough time interval.

3. A method of automatic voice activity detection for achieving source-controlled reduction of a mean transmission rate, the method comprising the steps of:

segmenting a speech signal into frames;

computing a wavelet transformation for each frame;

determining a set of parameters from the wavelet transformation;

determining a set of binary decision variables as a function of the set of parameters using fixed thresholds in an arithmetic circuit or a processor;

controlling a decision logic circuit using the binary decision variables;

producing a "speech present" statement or a "no speech" statement; and time smoothing each frame.

4. A circuit arrangement for using voice activity detection to achieve source-controlled reduction of a mean transmission rate, the circuit arrangement comprising:

a first transistor switch having an input and at least one output, the input for receiving input speech signals;

a second transfer switch having at least one input and an output, the output being connected to the input of a transmission channel;

a voice activity detection circuit having an input and an output, the input being connected to the input of the first transfer switch, the output being connected to the input of the transmission channel and to the first and second transfer switches for controlling the switches;

a speech encoder having an input and an output, the input being connected to the at least one output of the first transfer switch, the output being connected to the at least one input of the second transfer switch;

a background noise encoder having an input and an output, the input being connected to the at least one output of the first transfer switch, the output being connected to the at least one input of the second transfer switch;

a third transfer switch having a control, the third transfer switch and the control being connected to at least one output of the transmission channel;

a fourth transfer switch having an output and a control, the control being connected to the at least one output of the transmission channel; and a speech decoder and a background noise decoder arranged between the third transfer switch and the fourth transfer switch.

5. The circuit arrangement as recited in claim 4 wherein the voice activity detection circuit includes:

a segmenting circuit having an input and an output; and a wavelet transformation circuit having an input and an output, the input being connected to the output of the segmenting circuit.

6. The circuit arrangement as recited in claim 5 further comprising:

an arithmetic circuit or processor for calculating energy values, the circuit or processor having an input and an output, the input of the circuit or processor being connected to the output of the wavelet transformation circuit; and a pause detector having an input and an output, the input being connected to the output of the arithmetic circuit or processor.

7. The circuit arrangement as recited in claim 6 further comprising:

a circuit for detecting stationary states, the circuit having an input and an output, the input being connected to the output of the arithmetic circuit or processor in parallel with the pause detector;

a first background detector having an input and an output, the input being connected to the output of the arithmetic circuit or processor in parallel with the pause detector; and a second background detector having an input and an output, the input being connected to the output of the arithmetic circuit or processor in parallel with the pause detector.

8. The circuit arrangement as recited in claim 7 further comprising:

a decision logic circuit having and input and an output, the input being connected to the outputs of the pause detector, the circuit for detecting stationary states, the first background detector and the second background detector; and a smoothing circuit for time smoothing having an input and an output, the input being connected to the output of the decision logic circuit, the output forming the output of the voice activity detection circuit.

* * * * *